US007475725B2

(12) United States Patent
Yeh et al.

(10) Patent No.: US 7,475,725 B2
(45) Date of Patent: Jan. 13, 2009

(54) WELLBORE GRAVEL PACKING APPARATUS AND METHOD

(75) Inventors: Charles S. Yeh, Spring, TX (US); Bruce A. Dale, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 332 days.

(21) Appl. No.: 10/576,994

(22) PCT Filed: Oct. 14, 2004

(86) PCT No.: PCT/US2004/033900

§ 371 (c)(1),
(2), (4) Date: Apr. 25, 2006

(87) PCT Pub. No.: WO2005/061850

PCT Pub. Date: Jul. 7, 2005

(65) Prior Publication Data

US 2007/0114027 A1 May 24, 2007

Related U.S. Application Data

(60) Provisional application No. 60/526,521, filed on Dec. 3, 2003.

(51) Int. Cl.
*E21B 43/04* (2006.01)
*E21B 43/08* (2006.01)

(52) U.S. Cl. ..... 166/278; 166/51; 166/227

(58) Field of Classification Search ..... 166/51, 166/278, 227, 233, 235, 236
See application file for complete search history.

(56) References Cited

U.S. PATENT DOCUMENTS

| | | | | |
|---|---|---|---|---|
| 1,620,412 | A | 3/1927 | Tweeddale | |
| 2,158,569 | A | 5/1939 | Bowen | 73/51 |
| 2,312,862 | A | 3/1943 | Bermingham | 166/1 |
| 3,450,207 | A | 6/1969 | Hirsch | 166/236 |
| 3,556,219 | A | 1/1971 | Meldau | |
| 4,064,938 | A | 12/1977 | Fast | |
| 4,945,991 | A | 8/1990 | Jones | 166/278 |
| 5,076,359 | A | 12/1991 | Yeh | |
| 5,082,052 | A | 1/1992 | Jones et al. | |
| 5,113,935 | A | 5/1992 | Jones et al. | 166/51 |

(Continued)

FOREIGN PATENT DOCUMENTS

| | | |
|---|---|---|
| EP | 1277914 | 1/2003 |

(Continued)

*Primary Examiner*—Hoang Dang

(57) ABSTRACT

A wellbore apparatus and method for use in a wellbore for completion and production are disclosed. The apparatus comprises an outer permeable material (15) in the wellbore comprising a first basepipe section (11) with at least a portion of the basepipe is perforated (21), the first basepipe is inside the outer permeable material (15) and at least part of the perforated basepipe is designed to be adjacent to a production interval (14), a second basepipe section (10) with at least a portion of the second basepipe is slotted (16), the second basepipe is inside the outer permeable material (15) and above the perforated basepipe section (11) designed to be adjacent to the production interval wherein at least a portion of the slotted basepipe is designed to be adjacent to a non production section of the wellbore. The production completion apparatus may be installed into the wellbore to provide redundancy against well-screen failure.

50 Claims, 3 Drawing Sheets

U.S. PATENT DOCUMENTS 5,165,476 A 11/1992 Jones ..... 166/278
5,209,296 A 5/1993 Donlon et al.
5,222,556 A 6/1993 Donlon et al.
5,318,119 A 6/1994 Lowrey et al.
5,476,143 A 12/1995 Sparlin et al.
5,803,179 A 9/1998 Echols et al.
5,868,200 A 2/1999 Bryant et al.
5,881,809 A 3/1999 Gillespie et al.
6,745,843 B2 6/2004 Johnson et al. ..... 166/330
6,848,510 B2 2/2005 Bixenman et al.

FOREIGN PATENT DOCUMENTS

WO WO 2004/079145 A2 9/2004
WO WO2004/094784 11/2004
WO WO 2004/079145 A3 3/2005

WELLBORE GRAVEL PACKING APPARATUS AND METHOD

This application is the National Stage of International Application No. PCT/US2004/33900, filed Oct. 14, 2004, which claims the benefit of U.S. Provisional Patent Application No. 60/526,521, filed Dec. 3, 2003.

FIELD OF THE INVENTION

This invention relates generally to a wellbore apparatus and method for using the apparatus in a wellbore. More particularly, this invention relates to wellbore completion utilizing a wellbore apparatus suitable for gravel packing and production of hydrocarbons.

BACKGROUND

In the production of hydrocarbons from hydrocarbon-bearing unconsolidated formations, a well is provided which extends from the surface of the earth into the unconsolidated or poorly consolidated formation. The well may be completed by employing conventional completion practices, such as running and cementing casing in the well and forming perforations through the casing and cement sheath surrounding the casing, thereby forming an open production interval which communicates with the formation.

Hydrocarbon production from subterranean formations commonly includes a wellbore completed in either cased hole or open-hole condition. In cased-hole applications, a wellbore casing is placed in the wellbore and the annulus between the casing and the wellbore is filled with cement. Perforations are typically made through the casing and the cement into the production interval to allow formation fluids (such as, hydrocarbons) to flow from the production interval zones into the casing. A production string is then placed inside the casing, creating an annulus between the casing and the production string. Formation fluids flow into the annulus and then into the production string to the surface through tubing associated with the production string. In open-hole applications, the production string is directly placed inside the wellbore without casing or cement. Formation fluids flow into the annulus between the formation and the production string and then into production string to surface.

The production of hydrocarbons from unconsolidated or poorly consolidated formations may result in the production of sand along with the hydrocarbons. Produced sand is undesirable for many reasons. It is abrasive to components within the well, such as tubing, pumps and valves, and must be removed from the produced fluids at the surface. Further, it may partially or completely clog the well, thereby requiring an expensive workover. In addition, the sand flowing from the formation may leave a cavity, which may result in the formation caving and collapsing of the casing.

A technique commonly employed for controlling the flow of sand from an unconsolidated or poorly consolidated formation into a well involves the forming of a gravel pack in the well adjacent part or all of the unconsolidated or poorly consolidated formation exposed to the well. Thereafter, hydrocarbons are produced from the formation through the gravel pack and into the well. Gravel packs have generally been successful in mitigating the flow of sand from the formation into the well.

Several downhole solid, particularly sand, control methods being practiced in industry are shown in FIGS. 1(*a*), 1(*b*), 1(*c*) and 1(*d*). In FIG. 1(*a*), the production string or pipe (not shown) typically includes a permeable outer member (such as, a sand-screen or sand control device) 1 around its outer periphery, which is placed adjacent to each production interval. The sand-screen prevents the flow of sand from the production interval 2 into the production string (not shown) inside the sand-screen 1. Slotted or perforated liners can also be utilized as sand-screens or sand control devices. FIG. 1(*a*) is an example of a screen-only completion with no gravel pack present.

As discussed above, one of the most commonly used techniques for controlling sand production is gravel packing wherein sand or other particulate matter is deposited around the production string or well-screen to create a downhole filter. FIGS. 1(*b*) and 1(*c*) are examples of cased-hole and open-hole gravel packs, respectively. FIG. 1(*b*) illustrates the gravel pack 3 outside the screen 1, the wellbore casing 5 surrounding the gravel pack 3, and cement 8 around the wellbore casing 5. Typically, perforations 7 are shot through the wellbore casing 5 and cement 8 into the production interval 2 of the subterranean formations around the wellbore. FIG. 1(*c*) illustrates an open-hole gravel pack wherein the wellbore has no casing and the gravel pack material 3 is deposited around the wellbore sand-screen 1.

A variation of a gravel pack involves pumping the gravel slurry at pressures high enough so as to exceed the formation fracture pressure ("Frac-Pack"). FIG. 1(*d*) is an example of a Frac-Pack. The well-screen 1 is surrounded by a gravel pack 3, which is contained by a wellbore casing 5 and cement 8. Perforations 6 in the wellbore casing allow gravel to be distributed outside the wellbore to the desired interval. The number and placement of perforations are chosen to facilitate effective distribution of the gravel packing outside the wellbore casing to the interval that is being treated with the gravel-slurry.

One problem associated with gravel packing, especially with gravel packing long or inclined intervals, arises from the difficulty in completing packing the annulus between the screen and the casing for in-casing gravel packs or between the screen and the side of the hole for open hole or under-reamed gravel packs. Incomplete packing is often associated with the formation of sand "bridges" in the interval to be packed which prevent placement of sufficient sand below that bridge, for top down gravel packing, or above that bridge, for bottom up gravel packing. The problem associated with bridge formation is often circumvented by using alternate path technology, which provides separate pathways for sand laden slurry to reach locations above or below the sand bridge or bridges.

If the sand screen is damaged or impaired, sand infiltration may result causing flow impairment. Flow impairment during production from subterranean formations can result in a reduction in well productivity or complete cessation of well production. This loss of functionality may occur for a number of reasons, including but not limited to, migration of fines, shales, or formation sands, inflow or coning of unwanted fluids (such as, water or gas, formation of inorganic or organic scales, creation of emulsions or sludges), accumulation of drilling debris (such as, mud additives and filter cake), mechanical damage in sand control screen, incomplete gravel pack, and mechanical failure due to borehole collapse, reservoir compaction/subsidence, or other geomechanical movements.

Current industry well designs include little, if any, redundancy in the event of problems or failures resulting in flow impairment from well-screen failure. In many instances, the ability of a well to produce at or near its design capacity is sustained by only a "single" barrier to the impairment mechanism (for example, screen for ensuring sand control in unconsolidated formations). In many instances the utility of the well may be compromised by impairment occurring in a single barrier. Therefore, overall system reliability is very low. Flow impairment in wells frequently leads to expensive replacement drilling or workover operations.

The current industry standard practice utilizes some type of sand screen either alone or in conjunction with artificially placed gravel packs (sand or proppant) to retain formation sand. All of the prior art completion types are "single barrier" completions, with the sand screen being the last "line of defense" in preventing sand from migrating from the wellbore into the production tubing. Any damage to the installed gravel pack or screen will result in failure of the sand control completion and subsequent production of formation sand. Likewise, plugging of any portion of the sand control completion (caused by fines migration, scale formation, etc.) will result in partial or complete loss of well productivity.

Lack of any redundancy in the event of mechanical damage or production impairment results in the loss of well productivity from single barrier completion designs. Accordingly, there is a need for a well completion apparatus and method to protect the wellbore from gravel pack infiltration in the event of mechanical damage to the well screen. This invention satisfies this need.

SUMMARY

A wellbore apparatus is disclosed. The wellbore apparatus comprises, an outer permeable material, a first basepipe section wherein at least a portion of the basepipe is perforated, the first basepipe is inside the outer permeable material and at least part of the perforated basepipe is designed to be adjacent to a production interval, and a second basepipe section wherein at least a portion of the second basepipe is slotted, the second basepipe is inside the outer permeable material and above the perforated basepipe section designed to be adjacent to the production interval wherein at least a portion of the slotted basepipe is designed to be adjacent to a non production section of the wellbore, and the first and second basepipes providing a three-dimensional surface defining a fluid flow path through the wellbore.

A second wellbore apparatus is also disclosed. The apparatus comprises an outer permeable material, a perforated basepipe section inside the outer permeable material wherein at least part of the perforated basepipe is designed to be adjacent to a production interval of a wellbore, a slotted basepipe section inside the outer permeable material and above the perforated basepipe section designed to be adjacent to the production interval wherein at least a portion of the slotted basepipe is designed to be adjacent to a non perforated section of the wellbore, and the perforated and slotted basepipes providing a three-dimensional surface defining a fluid flow path through the well.

A method of well completion is also disclosed. The method comprises providing a wellbore apparatus comprising, providing a wellbore apparatus comprising an outer permeable material, a first basepipe section with at least a portion of the basepipe is perforated, the first basepipe is inside the outer permeable material and at least part of the perforated basepipe is designed to be adjacent to a production interval, and a second basepipe section with at least a portion of the second basepipe is slotted, the second basepipe is inside the outer permeable material and above the perforated basepipe section designed to be adjacent to the production interval wherein at least a portion of the slotted basepipe is designed to be adjacent to a non production section of the wellbore, the first and second basepipes providing a three-dimensional surface defining a fluid flow path through the wellbore, and installing the wellbore apparatus in a wellbore wherein at least part of the perforated basepipe inside the outer permeable material is adjacent to a production interval and at least part of slotted basepipe inside the outer permeable material is adjacent to a non production section of the wellbore.

BRIEF DESCRIPTION OF THE DRAWINGS

FIG. 1(*b*) is an illustration of a cased-hole gravel pack sand control completion;

FIG. 1(*c*) is an illustration of an open-hole gravel pack sand control completion;

FIG. 1(*d*) is an illustration of a Frac-Pack sand control completion;

FIG. 2(*b*) is a cross-section illustration of the wellbore apparatus of FIG. 2(*a*);

FIG. 3(*b*) is a cross-section illustration of the wellbore apparatus of FIG. 3(*a*);

FIG. 4(*b*) is a cross-section illustration of the wellbore apparatus of FIG. 4(*a*);

FIG. 5(*b*) is a cross-section illustration of the wellbore apparatus of FIG. 5(*a*).

DETAILED DESCRIPTION

In the following detailed description, the invention will be described in connection with its preferred embodiments. However, to the extent that the following description is specific to a particular embodiment or a particular use of the invention, this is intended to be illustrative only. Accordingly, the invention is not limited to the specific embodiments described below, but rather, the invention includes all alternatives, modifications, and equivalents falling within the true scope of the appended claims.

This invention discloses an wellbore apparatus for addressing gravel infiltration. The concept permits an outer permeable member or screen failure, by employing back-up media to retain gravel and form a stable gravel pack.

The apparatus comprises an outer permeable member in the wellbore with a slotted basepipe section and a perforated basepipe section inside the wellbore. At least a portion of the perforated basepipe section is adjacent to the wellbore and at least a portion of the slotted basepipe is above the production interval. The first and second basepipe provides a three-dimensional surface defining a fluid flow path through the wellbore.

Figure 1A:
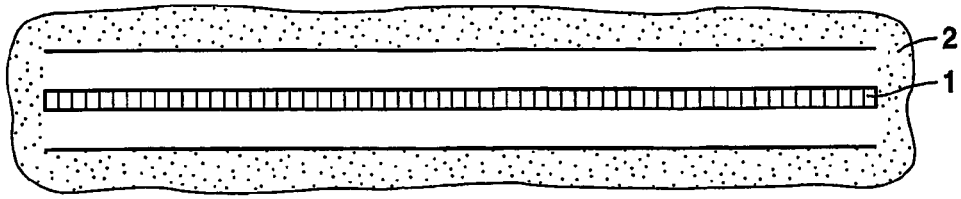
FIG. 1(*a*) is an illustration of a bare screen sand control completion.
Figure 1B:
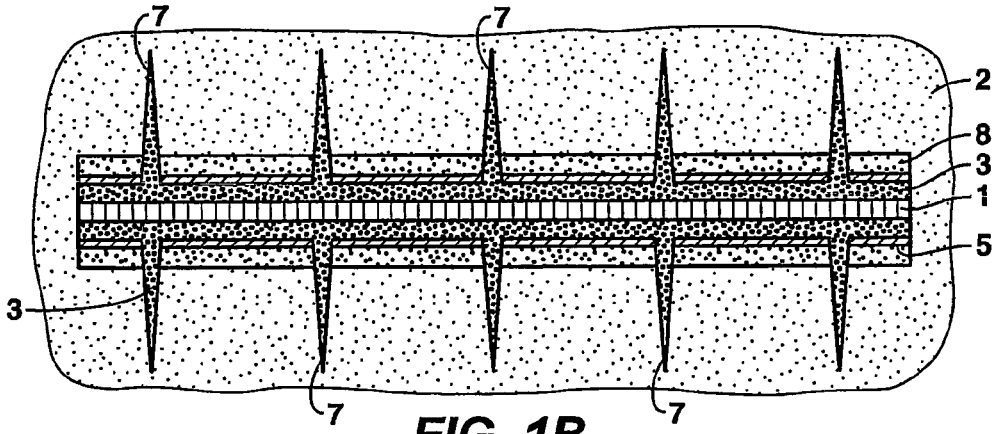
Figure 1C:
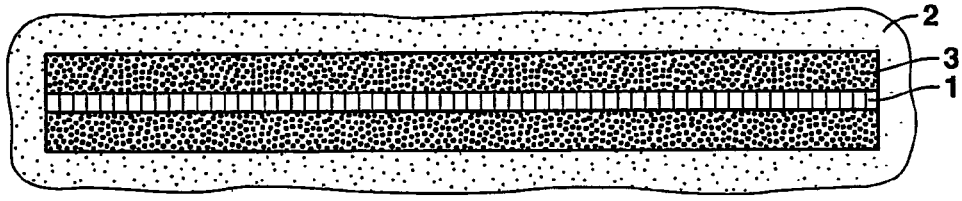
Figure 1D:
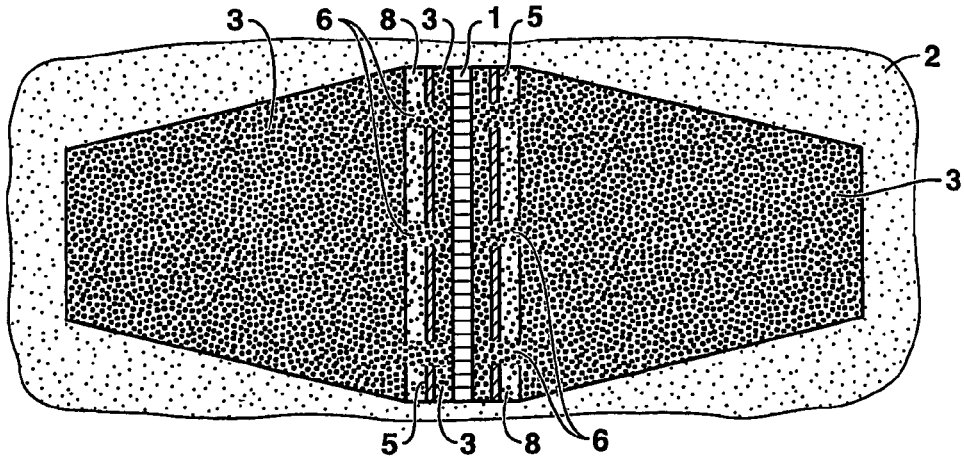
FIG. 1D (PRIOR ART)
Figure 2A:
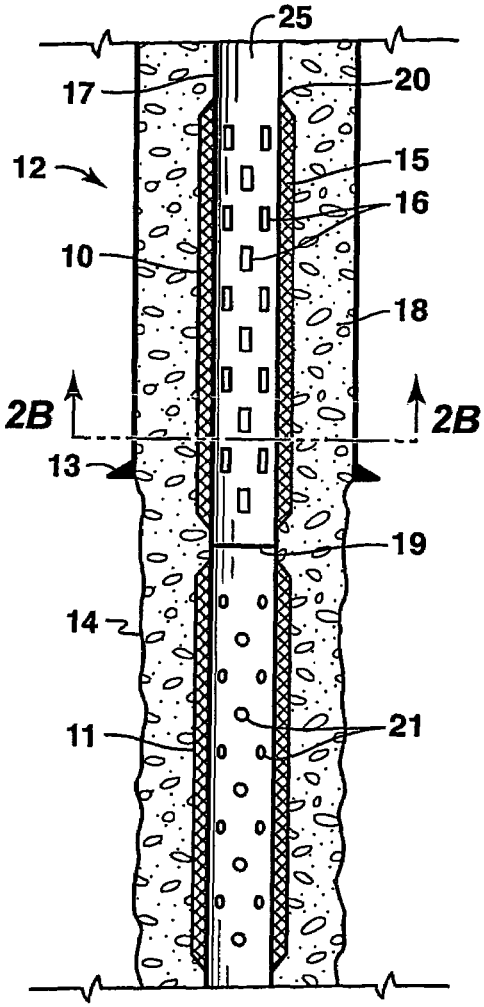
FIG. 2(*a*) is an illustration of an uncased production interval of a wellbore using an embodiment of the wellbore apparatus.
Figure 2B:
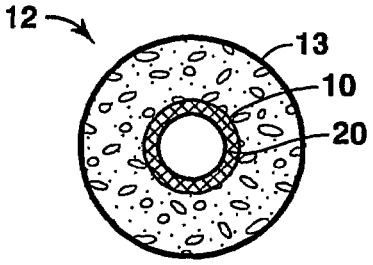

FIG. 2(*a*) illustrates an embodiment of the apparatus in an open-hole wellbore. Typically, as shown in FIG. 2(*a*), a series of screen joints 10 are placed in the wellbore. In open-hole completion 12, as shown in FIG. 2(*a*), the outer permeable member shown as a top screen joint 10, comprising a slotted basepipe 17, is typically located near or above the casing shoe 13. The lower outer permeable member shown as a screen joint is typically located in the production interval 14 against the open-hole pay sand. Gravel packing material 18 is typically placed in the wellbore outside the outer permeable members 15, which may also be referred to as outer permeable media, permeable media and/or outer permeable material. FIG. 2(*b*) is a cross section of the apparatus of FIG. 2(*a*) in which the like elements to FIG. 2(*a*) have been given like numerals. As shown in FIG. 2(*a*) the outer permeable member 15 retains the gravel packing material 18 from the basepipe 20. The interior of the basepipe 20 is a three-dimensional surface defining a fluid flow path through the wellbore. The interior 25 of the basepipe 20 is sometimes referred to as a production string. As shown in FIG. 2(*a*), at least a portion of a basepipe with perforations 21 is located adjacent to the production interval 14 and at least a portion of the slotted basepipe is located near or above a cased shoe 13 above the production interval 14. Typically, as shown in FIG. 2(*a*), the slots 16 are vertical but can be horizontal or slanted.

Figure 3A:
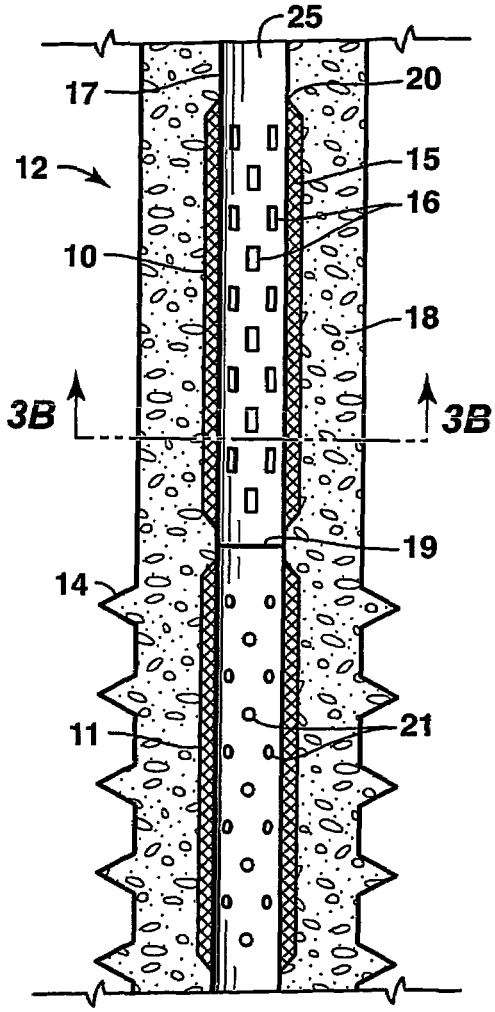
FIG. 3(*a*) is an illustration of a possible wellbore apparatus in a cased wellbore.
Figure 3B:
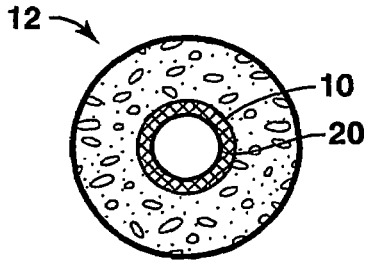

FIG. 3(*a*) is an illustration of the wellbore apparatus with a perforated cased-hole completion interval that is similar to the embodiment of FIG. 2(*a*) in which the like elements to FIG. 2(*a*) have been given like numerals. In cased-hole completion, as shown in FIG. 3(*a*) a top screen joint 10 is located near or above the top perforation and a lower screen joint 11 is located in the production interval 14 with perforations 21. In different embodiments there may be more than one top screen joint near or above the perforations 21. Furthermore, there may be more than one lower screen joint below the top perforation.

The lower permeable member or screen joint 11 may be a commercially available gravel pack screens, for example, wire-wrapped screen or mesh type screen. In this embodiment, inside the lower screen joint 11 is a perforated basepipe. The hole size of the perforations 21 is preferable large enough to allow gravel freely passing through. The top screen joint 10 contains a slotted basepipe 17 covered by a permeable media. The slot openings or slots 16 on the basepipe are sized to be small enough to retain gravel and large enough to allow residual mud and formation fines freely passing through. Preferably, the slot number or density is large enough so that the fluid flow friction is comparable or not much greater than the corresponding friction across the media of the outer permeable member 15. The top and lower screens may be connected by a coupling 19 on the basepipe such that the fluid could travel inside the basepipe between the two screen joints.

In one embodiment, alternate production flowpaths may be built into the apparatus to allow multiple flowpaths in the wellbore. Co-pending U.S. provisional application No. 60/459,151 discloses a Mazeflo device wherein multiple flowpaths are provided. U.S. Provisional Application No. 60/459,151 is hereby incorporated by reference.

Figure 4A:
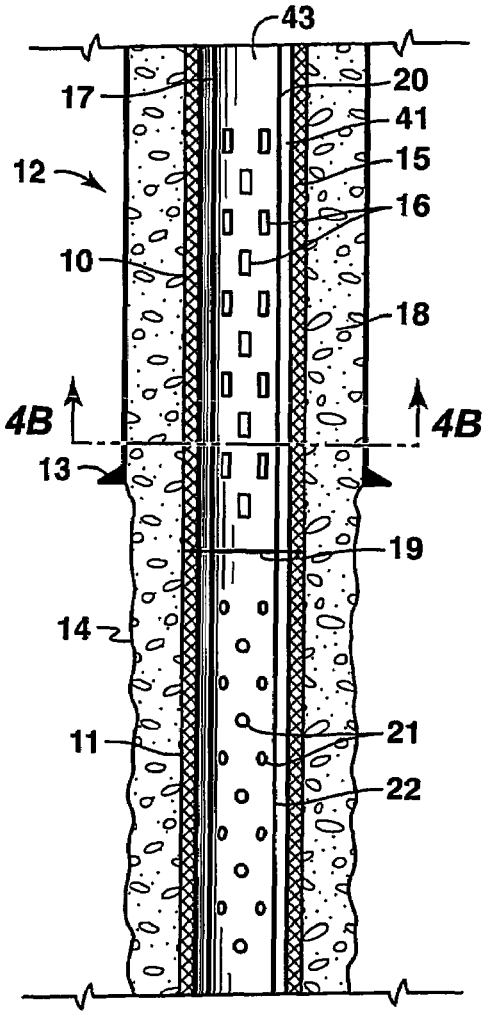
FIG. 4(*a*) is an illustration of an uncased production interval of a wellbore using an embodiment of the wellbore apparatus with alternate production flowpaths.
Figure 4B:
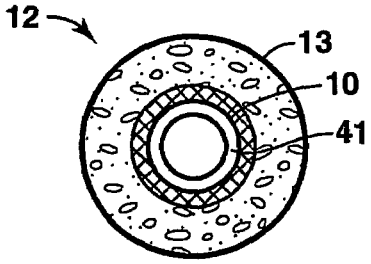

One example of a multiple flowpath embodiment would be to provide enough spacing between the perforated and slotted basepipes and the outer permeable member to form a second fluid flow joint. A flow joint is a separate three-dimensional surface defining a fluid flow path through the wellbore. FIG. 4(*a*) is an illustration of a multiple flowpath apparatus incorporating the Mazeflo design wherein the like elements to FIG. 2(*a*) have been given like numerals. In this embodiment the outer permeable member 15 is a well-screen that is a continuous well-screen providing a second flow path and joint 41 for production fluid through the wellbore. The first flow joint or screen 10 for fluid production is inside the slotted and perforated basepipes 17 and 22. In this embodiment the slots 16 and perforations 21 provide the permeable connection between the first and second flow joints and the weld joints 19 provide the section of separate flow within the second flow joint 41. The slotted and perforated basepipes can also be engineered to have impermeable solid sections and allow a variety of flow paths between the first and the second flow joints.

FIG. 4(*b*) is a cross-section of FIG. 4(*a*) wherein like elements to FIG. 4(*a*) have been given like numerals. As shown in FIG. 4(*b*) two distinct flow joints are available in this embodiment. The flow joint inside the basepipe is the first flow joint 43 and the area between the well-screen and basepipe forms the second flow joint 41. Additional flow joints can be created by the placement of additional basepipes, baffles and walls inside the wellbore. The additional flowjoints would provide redundancy permitting production of hydrocarbons despite sand infiltration from a sand-screen failure.

Figure 5A:
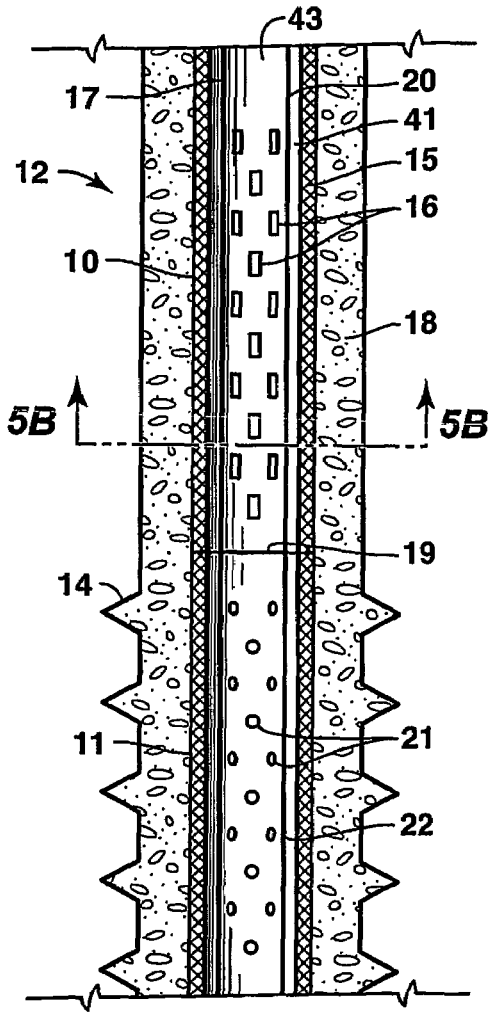
FIG. 5(*a*) is an illustration of a possible wellbore apparatus in a cased wellbore with alternate production flowpaths.
Figure 5B:
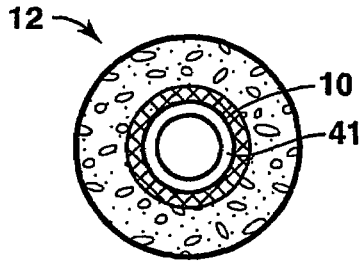

FIG. 5(*a*) is an illustration of a multiple flowpath apparatus in a cased wellbore incorporating the Mazeflo design wherein the like elements to FIG. 4(*a*) have been given like numerals. In this embodiment, at least a portion of the perforated basepipe 22 is adjacent to production interval 14 and at least a portion of the slotted basepipe 17 is adjacent to the cased interval above the top perforation 21. FIG. 5(*b*) is a cross section of FIG. 5(*a*) that is similar to FIG. 4(*a*) wherein similar elements are given like numerals. As shown in FIG. 5(*b*), the continuous sand-screen or sand joint 10 provides a second flow joint 41 with the inside of the basepipe 20 providing the first flow joint 43.

In one embodiment, the apparatus may be installed as a completion device before gravel packing. After installation of the apparatus the well is then gravel packed using alternate path shunts or conventional gravel packing technology. The basepipe inside the apparatus can be utilized as a production string producing hydrocarbons through the wellbore from the subterranean production interval to the surface of the earth.

EXAMPLE

During gravel packing, a slurry of mixing gravel in a carrier fluid is pumped into the annulus around both top and lower screens. As shown in FIG. 3(*a*), after the carrier fluid leaks off into formations or screens, gravel pack from the gravel packing material 18 is formed in the annulus. In the cased-hole completions, gravel pack is also formed inside the perforations 21. When the top screen joint of FIG. 3(*a*) is nearly covered by the annular gravel pack, the pumping pressure increases rapidly due to the diminishing area available for fluid flow. The high slurry injection pressure may instantly shear off the top screen jacket at the welding area or cause the wires of the screen (if wire-wrapped screen is used) parting due to both shear/compression load and erosion. In either case, gravel will intrude through the outer media of the outer permeable member 15. In conventional gravel pack completions, the top screen joint 10 is identical to the lower screen joint 11. That is, the top screen failure would result in losing gravel through the perforated pipe.

In the current invention, the intruded gravel will be retained by the slots 16 and maintain a stable gravel pack and gravel reserve. Since the slotted pipe is much stronger than either the welding area or the outer screen media of the outer permeable member 15, as well as the slotted pipe has not been exposed to long period of slurry erosion, the high slurry pressure could be sustained until sand-out, the end of gravel packing job. U.S. Pat. Nos. 4,945,991 and 5,113,935 disclose alternate path technology shunt tubes that can be attached to both top and lower screen joints. U.S. Pat. Nos. 4,945,991 and 5,113,935 are hereby incorporated by reference. With alternate path technology, maintaining high slurry injection pressure at reduced pumping rate is important in allowing shunt tubes to pack all voids in the wellbore. A relatively void-free or complete gravel pack promotes gravel pack longevity. The slots may be placed evenly over the entire basepipe in the top screen joint. The slots may also be placed on part, for example, the lower portion, of the basepipe to further enhance the mechanical strength in the basepipe of the top screen joint.

The slots are sized to retain gravel but allow free pass-through of residual mud and formation fines. During well production, the dominant flow path would typically in FIG. 2(*a*) and FIG. 3(*a*) be from open hole or perforated production interval 14 toward the lower screen joint 11. Since the top screen joints, 10 are not primary production flow paths, slot plugging, if occurs although unlikely, will have minimum impact on well productivity.

The apparatus may utilize slotted basepipe in the top screen joint or all or part of screen joints above the casing shoe (open-hole) or above the perforated interval (cased-hole). The current invention provides a reliable and forgiving apparatus and method to resolve gravel loss caused by screen damage during gravel packing. When the apparatus is applied to the field, the current screen manufacturing process and field operation procedures remain unchanged.

What is claimed is:

1. A wellbore apparatus comprising:

a) an outer permeable material;

b) a first basepipe section wherein at least a portion of the first basepipe section is perforated, the first basepipe section is inside the outer permeable material and at least part of the first basepipe section is adjacent to a production interval of a wellbore;

c) a second basepipe section wherein at least a portion of the second basepipe section is slotted, the second basepipe section is inside the outer permeable material and above the first basepipe section, wherein at least a portion of the second basepipe section is adjacent to a non production section of the wellbore;

d) the first basepipe section and second basepipe section providing a three-dimensional surface defining a fluid flow path through the wellbore.

2. The wellbore apparatus of claim 1 wherein the outer permeable material is a well-screen.

3. The wellbore apparatus of claim 1 wherein slots of the second basepipe section are at least large enough to permit passage of residual mud and formation fines and small enough to retain gravel.

4. The wellbore apparatus of claim 1 wherein the number of the slots is large enough for the friction of fluid flow through the slots to be comparable to or not much greater than the friction across the outer permeable material.

5. The wellbore apparatus of claim 1 further comprising alternate path technology shunts coupled to the outer permeable material.

6. The wellbore apparatus of claim 1 wherein the wellbore is an open-hole wellbore and at least part of the second basepipe section is above a casing shoe.

7. The wellbore apparatus of claim 1 wherein the wellbore is a cased-hole wellbore with a perforated interval and at least part of the second basepipe section is above a casing shoe above the perforated interval.

8. A wellbore apparatus, comprising:

a) an outer permeable member;

b) a perforated basepipe section inside the outer permeable member wherein at least part of the perforated basepipe section is adjacent to a production interval of a wellbore;

c) a slotted basepipe section inside the outer permeable member and above the perforated basepipe section, wherein at least a portion of the slotted basepipe section is adjacent to a non perforated section of the wellbore; and d) the perforated and slotted basepipe sections providing a three-dimensional surface defining a fluid flow path through the well.

9. The wellbore apparatus of claim 8 wherein the outer permeable member comprises a well-screen.

10. The wellbore apparatus of claim 8 wherein slots of the slotted basepipe section are at least large enough to permit passage of residual mud and formation fines and small enough to retain gravel.

11. The wellbore apparatus of claim 8 wherein the number of the slots is large enough for the friction of fluid flow through the slots to be comparable to or not much greater than the friction across the outer permeable member.

12. The wellbore apparatus of claim 8 further comprising alternate path technology shunts in the outer permeable member.

13. The wellbore apparatus of claim 8 wherein the wellbore is an open-hole wellbore and at least part of the second basepipe section is above the casing shoe above the production interval.

14. The wellbore apparatus of claim 8 wherein the production interval is a cased-hole wellbore with a perforated interval and at least part of the second basepipe section is above a casing shoe above the perforated interval.

15. A wellbore comprising:

a) an outer permeable member in the wellbore;

b) a first basepipe section with at least a portion of the first basepipe section being perforated, the first basepipe section is inside the outer permeable member and at least part of the first basepipe section is adjacent to a production interval;

c) a second basepipe section with at least a portion of the second basepipe section being slotted, the second basepipe section inside the outer permeable member and above the second basepipe section, wherein at least a portion of the second basepipe section is adjacent to a non production section of the wellbore.

16. The wellbore of claim 15 wherein the outer permeable member comprises a well-screen.

17. The wellbore of claim 15 wherein slots of the second basepipe section are at least large enough to permit passage of residual mud and formation fines and small enough to retain gravel.

18. The wellbore of claim 15 wherein the number of the slots is large enough for the friction of fluid flow through the slots to be comparable to or not much greater than the friction across the outer permeable member.

19. The wellbore of claim 15 further comprising alternate path technology shunts associated with the outer permeable member.

20. The wellbore of claim 15 wherein the wellbore is an open-hole wellbore and at least part of the second basepipe section is above a casing shoe.

21. The wellbore of claim 15 wherein the wellbore is a cased-hole wellbore with a perforated interval and at least part of the second basepipe section is above a casing shoe above the perforated interval.

22. A wellbore comprising:

a) a wellbore wherein the wellbore comprises at least one perforated section within a hydrocarbon production interval and at least one non perforated section above the at least one perforated section;

b) an outer permeable member in the wellbore;

c) a perforated basepipe section inside the outer permeable member, wherein at least part of the perforated basepipe section is adjacent to the at least one perforated section;

d) a slotted basepipe section inside the outer permeable member and above the perforated basepipe section, wherein at least a portion of the slotted basepipe section is adjacent to the at least one non perforated section; and e) the perforated and slotted basepipe sections providing a three-dimensional surface defining a fluid flow path through the wellbore.

23. The wellbore of claim 22 wherein the outer permeable member is well-screen.

24. The wellbore of claim 22 wherein slots of the slotted basepipe section are at least large enough to permit passage of residual mud and formation fines and small enough to retain gravel.

25. The wellbore of claim 22 wherein the number of slots in the slotted basepipe section is large enough for the friction of fluid flow through the slots to be at least equal to the friction across the outer permeable member.

26. The wellbore of claim 22 further comprising alternate path technology shunts in the outer permeable member.

27. The wellbore of claim 22 wherein the wellbore is an open-hole wellbore and at least part of the second basepipe section is above a casing shoe.

28. The wellbore of claim 22 wherein the wellbore is a cased-hole wellbore with a perforated interval and at least part of the second basepipe section is above a casing shoe above the perforated interval.

29. A method of completing a wellbore, comprising;

a) providing a wellbore apparatus comprising an outer permeable media, a first basepipe section with at least a portion of the first basepipe section being perforated and disposed inside the outer permeable media, and a second basepipe section with at least a portion of the second basepipe section being slotted, the second basepipe section disposed inside the outer permeable media and above the first basepipe section; and b) disposing the wellbore apparatus in a wellbore wherein at least part of the first basepipe section is adjacent to a production interval and at least part of second basepipe section is adjacent to a non production section of the wellbore.

30. The method of claim 29 further comprising gravel packing the first basepipe section and at least a portion of the second basepipe section within the wellbore.

31. The method of claim 29 further comprising producing hydrocarbons from the wellbore.

32. The method of claim 29 wherein at least part of the first basepipe section is adjacent to the production interval that is cased with perforations and at least a portion of the second basepipe section is adjacent to a non perforated section of the wellbore.

33. The method of claim 29 wherein the outer permeable media is a well-screen.

34. The method of claim 29 wherein the second basepipe section has slots that are at least large enough to permit passage of residual mud and formation fines and small enough to retain gravel.

35. The method of claim 29 wherein the number of the slots in the second basepipe section is large enough for the friction of fluid flow through the slots to be at least equal to the friction across the outer permeable media.

36. The method of claim 29 further comprising alternate path technology shunts in the outer permeable media.

37. The method of claim 29 wherein the wellbore is an open-hole wellbore and at least part of the second basepipe section is above a casing shoe.

38. The method of claim 29 wherein the wellbore is a cased-hole wellbore with a perforated interval and at least part of the second basepipe section is above a casing shoe above the perforated interval.

39. A wellbore apparatus comprising:

a perforated basepipe, wherein at least a portion of the perforated basepipe is disposed adjacent to a production interval of a wellbore, and wherein a first outer permeable media is coupled to the perforated basepipe; and a slotted basepipe coupled to the perforated basepipe and disposed closer to the surface of the wellbore than the perforated basepipe, wherein a second outer permeable media is coupled to the slotted basepipe.

40. The wellbore apparatus of claim 39 wherein at least a portion of the slotted basepipe is disposed adjacent to a non production interval of the wellbore.

41. The wellbore apparatus of claim 39 wherein the first outer permeable media and the second outer permeable media comprise well screens.

42. The wellbore apparatus of claim 39 wherein the number of the slots in the slotted basepipe are configured to maintain a comparable friction of fluid flow for fluid through the slots and across the outer permeable media.

43. The wellbore apparatus of claim 39 further comprising alternate path technology shunts associated with the outer permeable media.

44. The wellbore apparatus of claim 39 wherein slots of the slotted basepipe are configured to permit passage of residual mud and formation fines and small enough to retain gravel.

45. The wellbore apparatus of claim 39 wherein the perforated basepipe is utilized to produce hydrocarbons from the wellbore.

46. A method comprising;

disposing at least a portion of a perforated basepipe adjacent to a production interval of a wellbore, wherein a first outer permeable media is coupled to the perforated basepipe; and disposing a slotted basepipe in the wellbore, wherein the slotted basepipe is coupled to the perforated basepipe and positioned closer to the surface of the wellbore than the perforated basepipe, and wherein a second outer permeable media is coupled to the slotted basepipe.

47. The method of claim 46 wherein at least a portion of the slotted basepipe is disposed adjacent to a non production interval of the wellbore.

48. The method of claim 46 comprising gravel packing the perforated basepipe and at least a portion of the slotted basepipe within the wellbore.

49. The method of claim 46 comprising producing hydrocarbons from the wellbore via the perforated basepipe and the slotted basepipe.

50. The method of claim 46 further comprising alternate path technology shunts coupled to the perforated basepipe and the slotted basepipe.

* * * * *